US011441870B2

(12) United States Patent
Underwood et al.

(10) Patent No.: US 11,441,870 B2
(45) Date of Patent: Sep. 13, 2022

(54) FORWARD BRACE ASSEMBLY

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 17/073,278

(22) Filed: Oct. 16, 2020

(65) Prior Publication Data

US 2021/0116211 A1 Apr. 22, 2021

Related U.S. Application Data

(60) Provisional application No. 62/923,445, filed on Oct. 18, 2019.

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41C 23/12; F41A 23/08; F41A 23/04
See application file for complete search history.

(56) References Cited

U.S. PATENT DOCUMENTS 2,664,659 A * 1/1954 Parker ..... F41A 23/00 42/94
2,943,547 A * 7/1960 Martin ..... F41J 5/10 396/426
5,068,992 A * 12/1991 Velezis ..... F41A 35/06 42/72
7,055,749 B2 * 6/2006 Wulff ..... G06F 3/0202 235/462.45
D585,517 S * 1/2009 Faifer ..... D22/108
D643,497 S * 8/2011 Fitzpatrick ..... D22/108
8,707,604 B2 * 4/2014 Troy ..... F41A 23/10 42/72
9,097,480 B2 * 8/2015 Keng ..... F41A 9/65
D745,623 S * 12/2015 Flores ..... D22/108
D745,940 S * 12/2015 Flores ..... D22/108
D783,757 S * 4/2017 Jen ..... D22/108
D786,384 S * 5/2017 Saadon ..... D22/108
D790,650 S * 6/2017 Saadon ..... D22/108
D790,651 S * 6/2017 Saadon ..... F41C 23/16 D22/108
9,677,846 B1 * 6/2017 Vankeuren, III ..... F41C 23/00
9,784,527 B2 * 10/2017 Helms ..... F41C 23/16
9,784,529 B1 * 10/2017 Angle ..... F41C 27/22
D803,971 S * 11/2017 Saadon ..... F41C 23/16 D22/108
10,036,609 B1 * 7/2018 Rojas Garcia ..... F41C 23/16
10,094,636 B1 * 10/2018 Asbury ..... F41C 23/16
10,190,840 B1 * 1/2019 Renteria ..... F41A 23/02
10,222,171 B2 * 3/2019 Chavez ..... F41G 11/003
D860,375 S * 9/2019 Chavez ..... D22/109
(Continued)

*Primary Examiner* — Michelle Clement

(57) ABSTRACT

A forward brace assembly for a firearm includes a forward portion designed to interface with an operator's off hand and an aft panel extending rearward from the forward portion. At least a portion of the forward brace assembly is attached to an underside of a handguard of the firearm. The aft panel prevents the operator's off hand from wrapping around a rear side of the forward portion.

25 Claims, 6 Drawing Sheets

(56) References Cited

U.S. PATENT DOCUMENTS 10,495,407 B1 * 12/2019 Shelton ..... F41C 23/16
10,545,006 B1 * 1/2020 Zhang ..... F41C 23/12
D876,570 S * 2/2020 Saadon ..... D22/108
10,612,880 B1 * 4/2020 Ding ..... F41A 35/06
10,684,089 B2 * 6/2020 Keng ..... F41A 23/02
D898,153 S * 10/2020 Podgurny ..... F41C 23/16
D22/108
D904,546 S * 12/2020 Cheng ..... D22/108
10,866,062 B1 * 12/2020 Derousse ..... F41C 27/00
11,118,859 B1 * 9/2021 Hawk ..... F21V 23/0414
11,193,724 B1 * 12/2021 McCarthy ..... F41C 27/00
2003/0127085 A1 * 7/2003 Brunette ..... F41B 11/55
124/74
2011/0107643 A1 * 5/2011 Fitzpatrick ..... F41C 23/16
42/72
2011/0185617 A1 * 8/2011 Brixius ..... F41C 23/12
42/71.01
2013/0000174 A1 * 1/2013 Troy ..... F41A 23/10
42/72
2015/0233668 A1 * 8/2015 Moore ..... F41G 1/35
42/72
2016/0061560 A1 * 3/2016 Saadon ..... F41C 23/16
42/72
2016/0069632 A1 * 3/2016 Williams ..... F41A 23/02
42/94
2016/0327371 A1 * 11/2016 Teetzel ..... F41C 23/16
2016/0349004 A1 * 12/2016 Helms ..... F41C 23/16
2017/0045330 A1 * 2/2017 Bubits ..... F41C 23/12
2018/0135938 A1 * 5/2018 Jen ..... F41C 27/00
2018/0156569 A1 * 6/2018 Chavez ..... F41G 11/003
2018/0224233 A1 * 8/2018 Macy ..... F41A 11/02
2019/0316874 A1 * 10/2019 McPherson ..... F41C 23/16
2019/0323791 A1 * 10/2019 Walthert ..... F41B 5/123
2019/0390935 A1 * 12/2019 Purkiss ..... F41C 27/22
2020/0011636 A1 * 1/2020 Jen ..... F41C 33/007
2020/0109912 A1 * 4/2020 Parra ..... F41C 23/16
2020/0124377 A1 * 4/2020 McPherson ..... F41B 5/1426
2020/0141688 A1 * 5/2020 Pearce ..... F41C 23/22
2020/0284549 A1 * 9/2020 Teetzel ..... F41C 27/06
2021/0108885 A1 * 4/2021 Derousse ..... F41C 23/16
2021/0116211 A1 * 4/2021 Underwood ..... F41C 23/16
2021/0270573 A1 * 9/2021 Verjovsky ..... F41C 23/22
2021/0372733 A1 * 12/2021 Hall ..... F41C 23/16

* cited by examiner

FORWARD BRACE ASSEMBLY

CROSS REFERENCE TO RELATED APPLICATION

This application is related to and claims priority benefit from U.S. Provisional Application No. 62/923,445 ("the '445 application"), filed on Oct. 18, 2019 and entitled "FORWARD BRACE ASSEMBLY." The '445 application is hereby incorporated in its entirety by this reference.

FIELD OF THE INVENTION

The field of the invention relates to firearms, particularly forward brace assemblies for firearms where the forward brace extends rearward toward other portions of the firearm.

BACKGROUND

Many modern firearms are designed based on existing modular firearm systems. For example, many firearms and related accessories are designed for compatibility with the AR-15 variant (civilian) or M16/M4 (military) firearm platform. Many of these products follow traditional designs based on industry standards and/or military specification (milspec). However, many of the existing components are not compatible and/or are not legal with specific configurations. For example, AR-15 style firearms with barrels shorter than 16" may be classified as a pistol in certain circumstances. A popular accessory for AR-15 style firearms for some consumers is a forward grip for the operator's off hand (i.e., non-shooting hand). However, certain configurations of forward grips when attached to a AR-15 pistol would change the status of the firearm from pistol to an "any other weapon" (AOW), which would require National Firearms Act (NFA) registration to legally own/operate the firearm (according to the Bureau of Alcohol, Tobacco, Firearms and Explosives).

To increase comfort, maneuverability, and ergonomics while maintaining legal status without implicating the NFA, it may be desirable to design new forward brace assemblies.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a forward brace assembly for a firearm comprises: a forward portion designed to interface with an operator's off hand; and an aft panel extending rearward from the forward portion, wherein: at least a portion of the forward brace assembly is attached to an underside of a handguard of the firearm; and the aft panel prevents the operator's off hand from wrapping around a rear side of the forward portion.

According to certain embodiments of the present invention, a firearm comprises: at least one receiver with a magazine well; a pistol grip attached to the at least one receiver, wherein the pistol grip is designed to interface with an operator's shooting hand; a handguard disposed forward of the at least one receiver; a forward brace assembly disposed below the handguard, the forward brace assembly comprising: a forward portion designed to interface with an operator's off hand; and an aft panel extending rearward from the forward portion, wherein: at least a portion of the forward brace assembly is attached to an underside of a handguard of the firearm; and the aft panel prevents the operator's off hand from wrapping around a rear side of the forward portion.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1A-6B illustrate components of various semi-automatic or automatic firearms, the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP; and shotgun calibers such as, for example, 12 gauge, 20 gauge, 28 gauge, 0.410 gauge, 10 gauge, 16 gauge. The illustrated embodiments focus on a lower receiver for the AR-15 variant (civilian) or M16/M4 (military) firearm platform; however, the concepts and features described herein can be are also applicable (with potential necessary alterations for particular applications) to other components of the AR-15/M16/M4 platform (i.e., AR-15 style firearms) and to components of various other firearms.

Figure 1A:
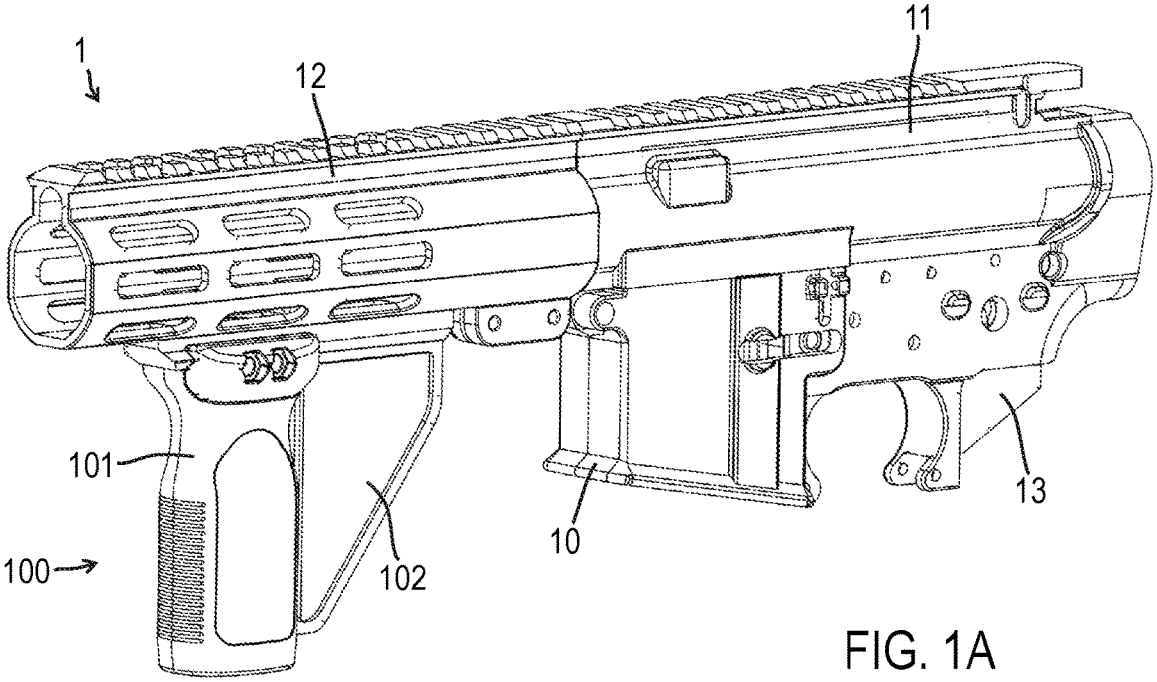
FIG. 1A is a front left perspective view of a forward brace assembly according to certain embodiments of the present invention.
Figure 1B:
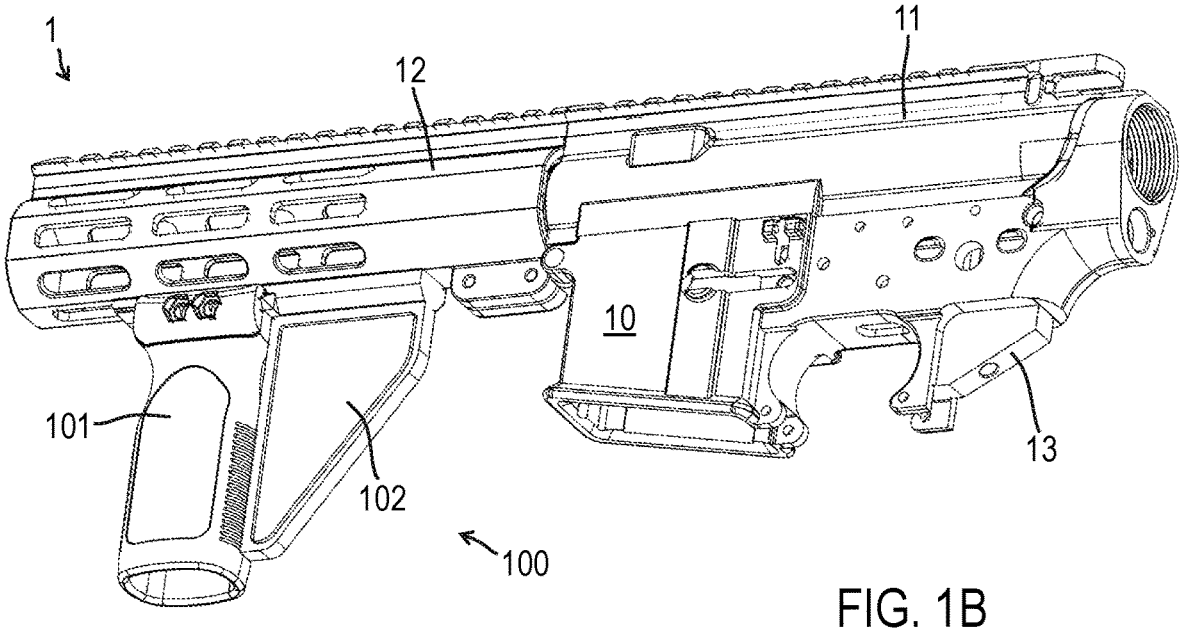
FIG. 1B is a rear left perspective view of the forward brace assembly of FIG. 1A.
Figure 2A:
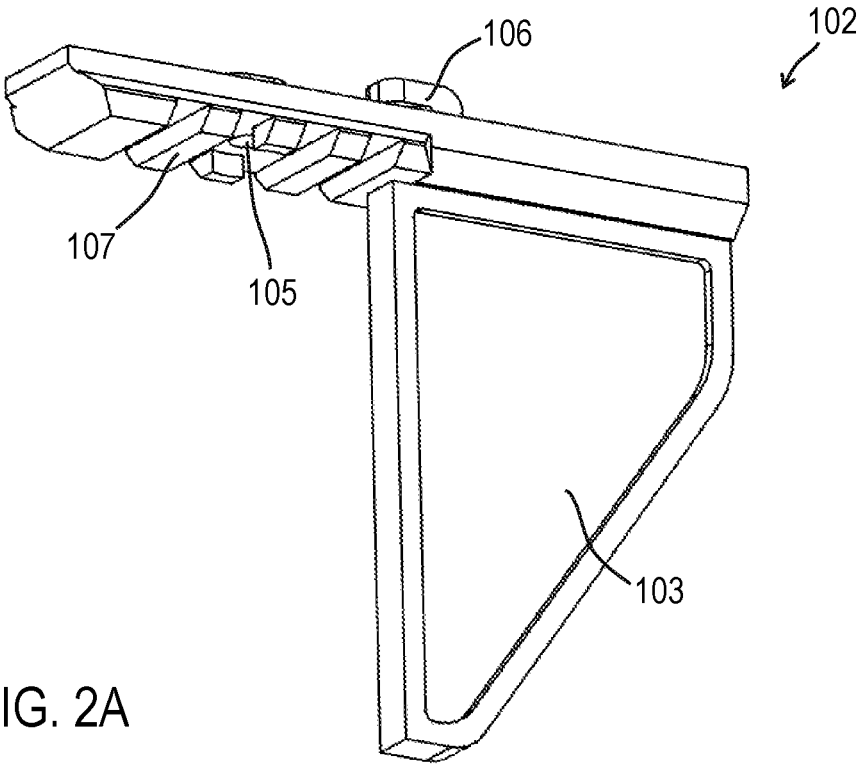
FIG. 2A is a front left perspective view of an aft panel of the forward brace assembly of FIG. 1A.
Figure 2B:
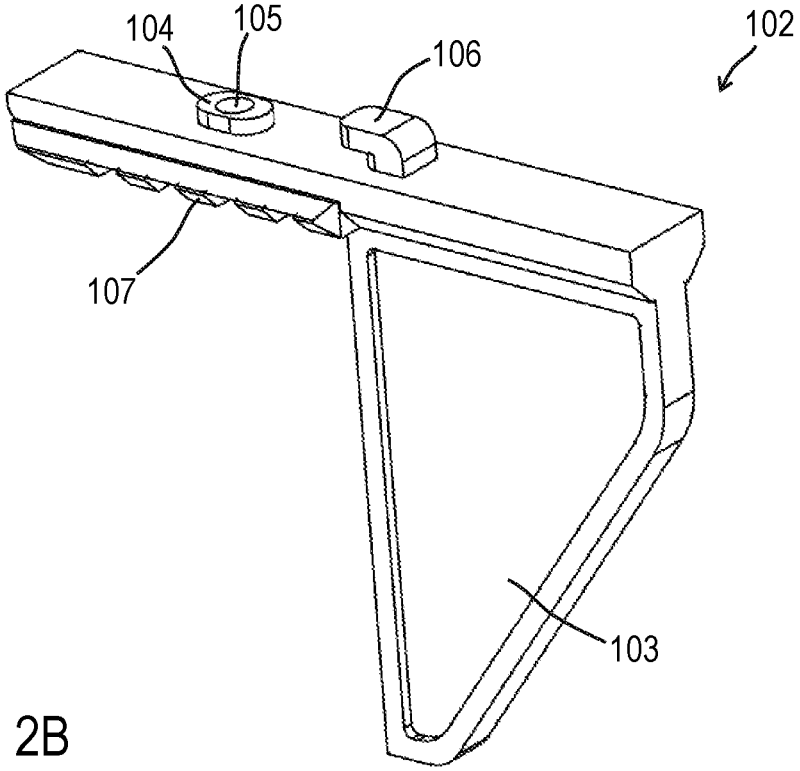
FIG. 2B is a rear left perspective view of the aft panel of FIG. 2A.

In some cases, a firearm 1 includes a lower receiver 10, an upper receiver 11, a handguard 12, and a forward brace assembly 100 (see FIGS. 1A and 1B). A standard pistol grip may be attached to the lower receiver 10 at the pistol grip interface 13 for the operator's shooting hand. The standard pistol grip is not illustrated as a person having ordinary skill in the art would understand a pistol grip for the operator's shooting hand. The forward brace assembly 100 may be added for the operator's off hand. In some embodiments, the forward brace assembly 100 may include a forward portion 101 and an aft panel 102. As shown in FIGS. 1A, 1B, and 3-6B, in some embodiments, the aft panel 102 extends rearward toward a forward portion of the lower receiver 10 (i.e., approaching the magazine well area of the lower receiver 10). The forward portion 101 may include a rounded or partially cylindrical shape such that an operator can wrap at least a portion of his/her hand around the front surface of the forward portion 101. In some cases, the forward portion 101 may include grooves corresponding to an operator's fingers.

As shown in FIGS. 1A, 1B, and 3-6B, the aft panel 102 extends from a rear side of the forward portion 101 to an area adjacent to the receiver of the firearm (e.g., the lower receiver 10). In some embodiments, the configuration of the aft panel 102 prevents an operator from wrapping his/her entire off hand around the forward portion 101. In other words, in some cases, the operator may wrap his/her four fingers of the off hand around the front surface of the forward portion 101 but the aft panel 102 prevents his/her thumb from wrapping around a rear side of the forward portion 101.

The forward brace assembly 100 may include a separate forward portion 101 and aft panel 102 such that these components are removably attached to one another. As one example, as shown in FIGS. 1A-2B, the aft panel 102 may attach to an underside of the handguard 12. The aft panel 102 may attach directly to the handguard 12, to a rail attached to the handguard 12 (e.g., a MIL-STD-1913 rail, a M-LOK® rail, a KeyMod rail, a Weaver rail, and/or any other type of rail system). In some embodiments, the aft panel 102 includes a hook portion 106 that that is aligned with and passes through an opening of the handguard 12 before engaging an edge of the opening of the handguard 12. In addition, the aft panel 102 may include a protrusion 104 that includes a fastener hole 105 for securing the aft panel 102 relative to the handguard 12. The underside of the front portion of the aft panel 102 may include a rail 107 (e.g., a MIL-STD-1913 rail, a M-LOK® rail, a KeyMod rail, a Weaver rail, and/or any other type of rail system). In some embodiments, the forward portion 101 may attach to this rail 107 of the aft panel 102 (see FIGS. 1A and 1B). In other words, in some examples, the aft panel 102 may be used with conventional forward grips that are compatible with rail attachments.

As shown in FIGS. 3-6B, the forward portion 101 and the aft panel 102 may be integrally formed with one another as a unitary component. In such embodiments, at least one of the forward portion 101 and the aft panel 102 includes features for engaging and attaching to the handguard 12 and/or to a rail (e.g., a MIL-STD-1913 rail, a M-LOK® rail, a KeyMod rail, a Weaver rail, and/or any other type of rail system).

Figure 3:
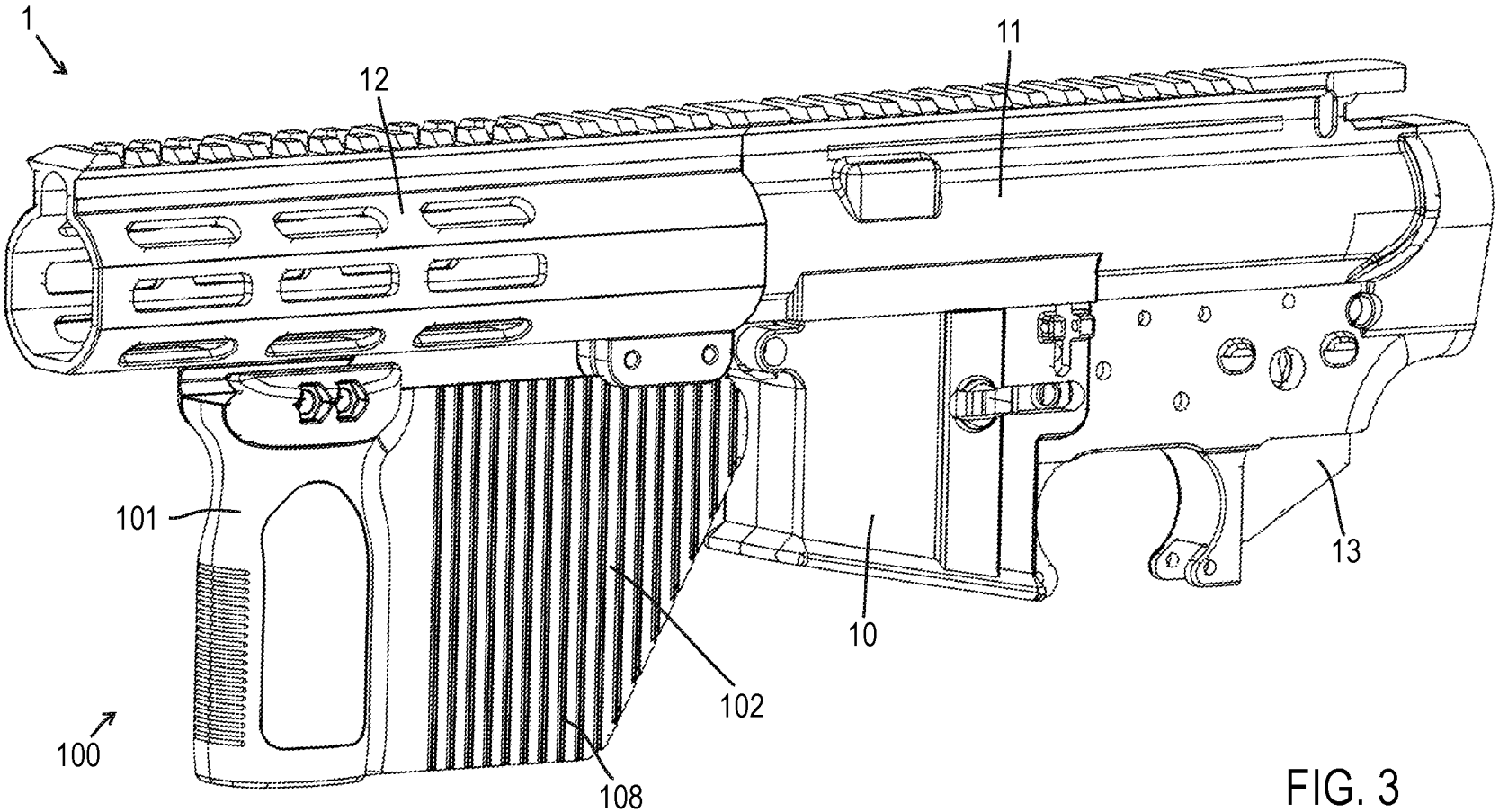
FIG. 3 is a front left perspective view of a forward brace assembly according to certain embodiments of the present invention.
Figure 4:
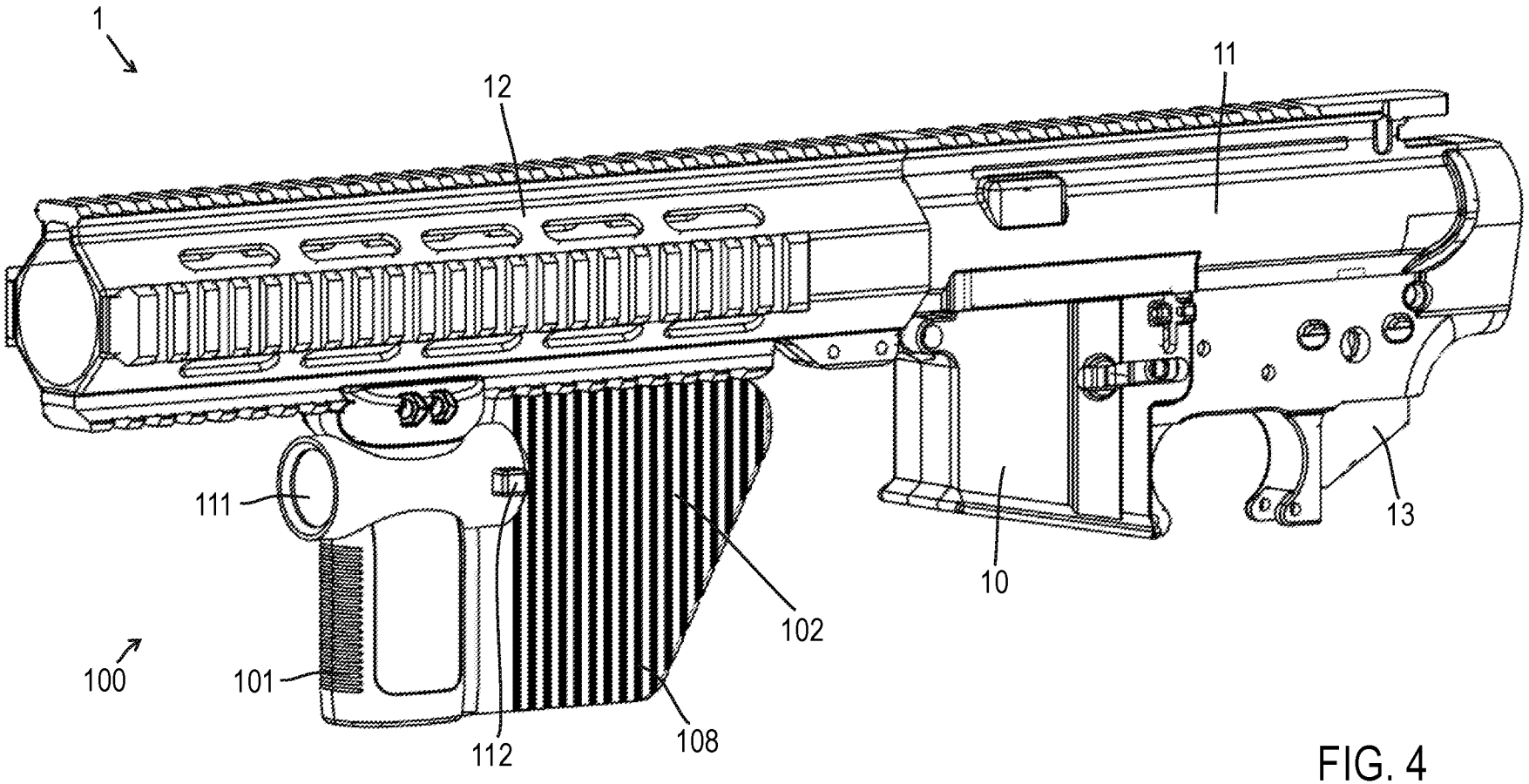
FIG. 4 is a front left perspective view of a forward brace assembly according to certain embodiments of the present invention.
Figure 5:
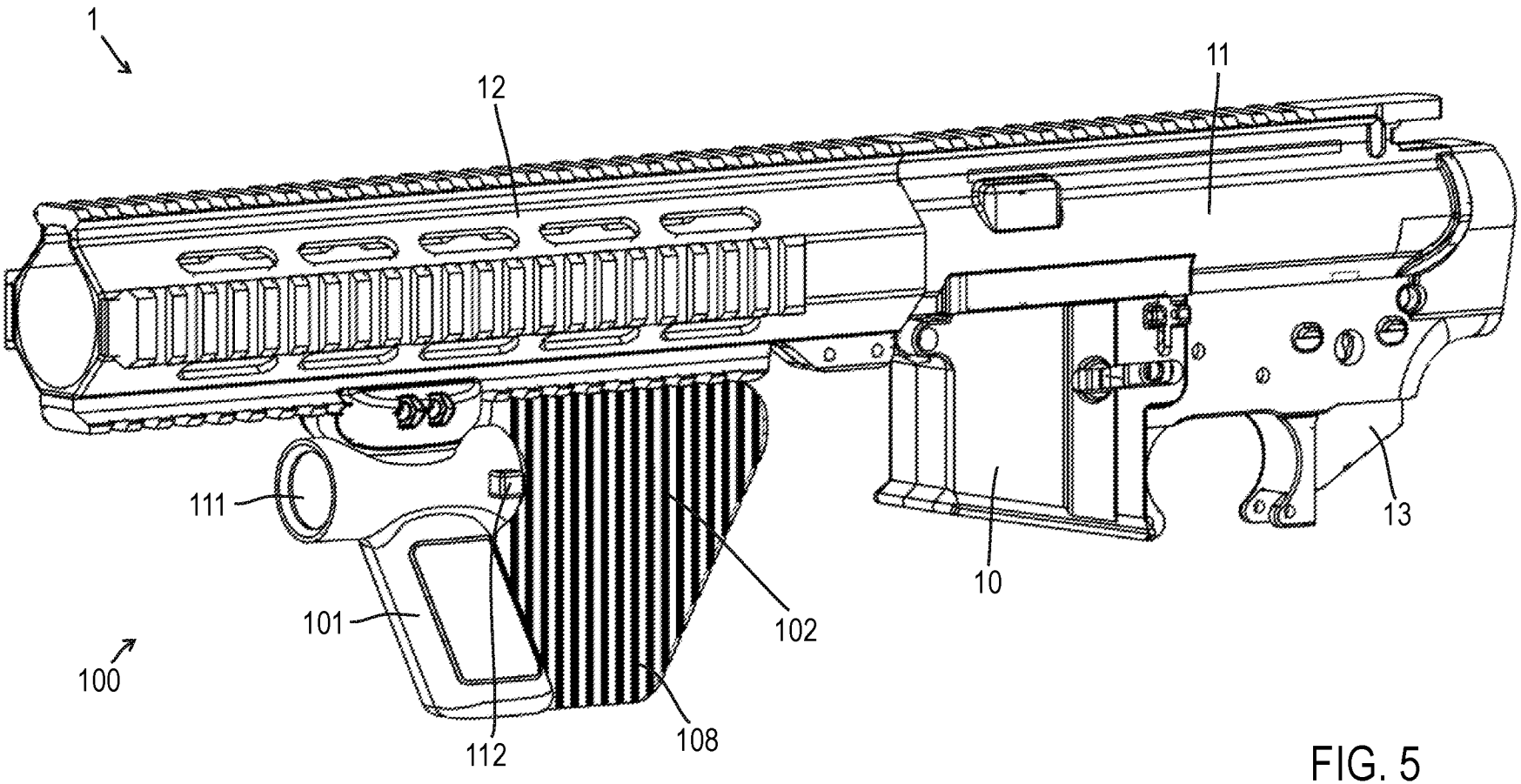
FIG. 5 is a front left perspective view of a forward brace assembly according to certain embodiments of the present invention.

In some embodiments, the aft panel 102 is a modular component such that the forward brace assembly 100 can be retrofitted to a variety of firearms in a custom position/configuration based on an individual operator's preferences. In some cases, the aft panel 102 includes multiple sections that can be individually snapped or removed to extend into and/or fill an area between the rear side of the forward portion 101 and the area adjacent to the lower receiver 10 of the firearm 1. For example, the aft panel 102 may include a plurality of pre-defined edges or score lines (e.g., see edges 108 in FIGS. 3-5) such that portions of the aft panel 102 can be removed to achieve a desired configuration. In some cases, the aft panel includes multiple removeable and replaceable sections (e.g., defined by edges 108) that can removed and inserted to adjust the size of the aft panel. As shown in FIGS. 3-5, the removeable and replaceable sections may have varying dimensions including, for example, varying lengths extending down from the handguard.

As shown in FIGS. 4-6B, the forward brace assembly 100 may include an accessory 111. In some embodiments, the accessory 111 may include at least one of a flashlight, a laser, an infrared laser or light emitter, an ultraviolet light emitter, a microphone, a regular camera, a night-vision camera, a thermal imaging camera, an infrared camera, forward-looking infrared (FLIR), and/or any other appropriate device. The accessory 111 may include at least one control 112 (e.g., a switch, a button, etc.).

Figure 6A:
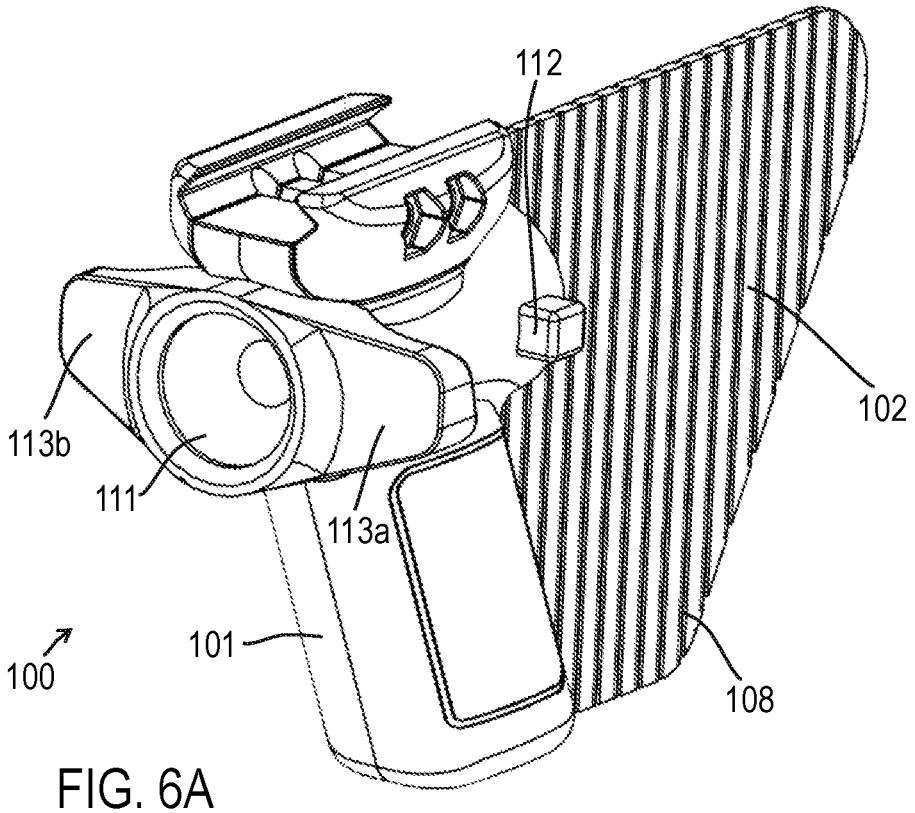
FIG. 6A is a front left perspective view of a forward brace assembly according to certain embodiments of the present invention.
Figure 6B:
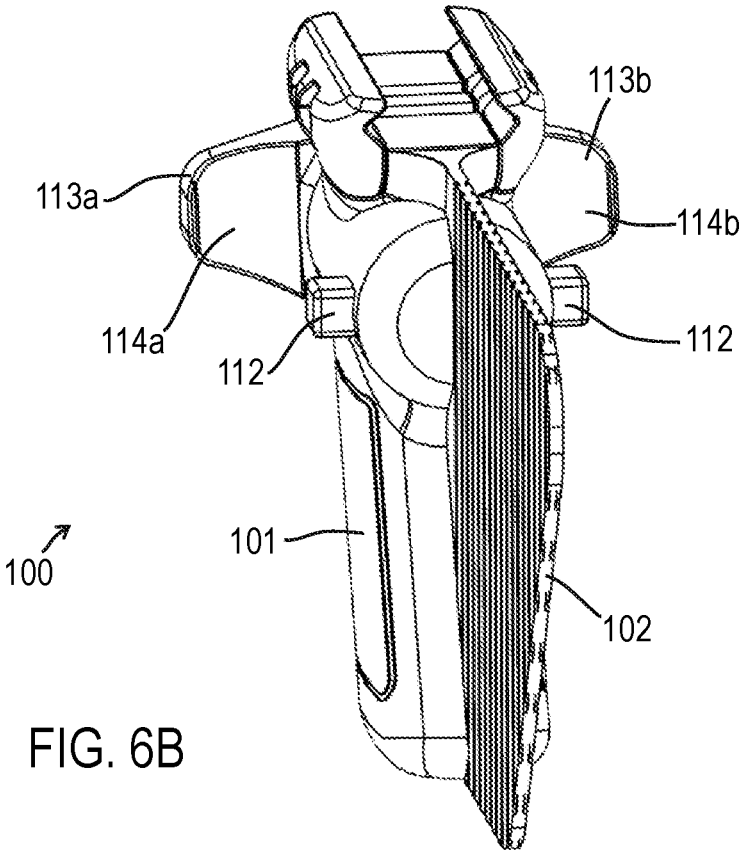
FIG. 6B is a rear left perspective view of the forward brace assembly of FIG. 6A.

FIGS. 5-6B show examples of a forward brace assemblies 100 where the forward portion 101 is angled toward the rear of the firearm 1. In other words, the forward portion 101 is not perpendicular to the handguard 12. Although FIG. 5 illustrates the angled forward portion 101 in combination with an accessory 111, the angled forward portion 101 may be combined with any configuration of the forward brace assembly 100, including the configurations shown in FIGS. 1A-3. FIG. 5 illustrates the forward portion 101 angled toward the rear of the firearm; however, the forward portion 101 may be angled in any direction, including toward the front of the firearm or in a lateral direction. In some embodiments, the forward portion 101 is angled approximately 15° rearward from a vertical configuration (i.e., see vertical configuration in FIGS. 1A, 1B, 3, and 4 where the forward portion 101 is approximately perpendicular to the handguard 12). In certain embodiments, the forward portion 101 is angled approximately 20° rearward from a vertical configuration. In other embodiments, the forward portion 101 is angled approximately 25° rearward from a vertical configuration. In some embodiments, the forward portion 101 is angled approximately 30° rearward from a vertical configuration. In certain embodiments, the forward portion 101 is angled approximately 35° rearward from a vertical configuration. In other embodiments, the forward portion 101 is angled approximately 40° rearward from a vertical configuration. In some embodiments, the forward portion 101 is angled approximately 45° rearward from a vertical configuration. In certain embodiments, the forward portion 101 is angled approximately 50° rearward from a vertical configuration. In other embodiments, the forward portion 101 is angled approximately 55° rearward from a vertical configuration. In some embodiments, the forward portion 101 is angled approximately 60° rearward from a vertical configuration.

In some embodiments, the forward brace assembly 100 may include at least one thumb rest 113*a*, 113*b* (see FIGS. 6A and 6B). For example, the forward brace assembly 100 may include a left side thumb rest 113*a* that includes a contoured surface 114*a* for interfacing with the thumb of the operator's left hand (i.e., for a right handed shooter). The contoured surface 114*a* may include a contoured surface (with a curved profile in one direction), a compound curved surface (with a curved profile in at least two different directions), and/or any other appropriate surface shape. Similarly, the forward brace assembly 100 may include a right side thumb rest 113*b* that includes a contoured surface 114*b* for interfacing with the thumb of the operator's right hand (i.e., for a left handed shooter). The contoured surface 114*b* may include a contoured surface (with a curved profile in one direction), a compound curved surface (with a curved profile in at least two different directions), and/or any other appropriate surface shape.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

The components of any of the firearms 1 and/or forward brace assemblies 100 described herein may be formed of materials including, but not limited to, thermoplastic, carbon composite, plastic, nylon, steel, aluminum, stainless steel, high strength aluminum alloy, other plastic or polymer materials, other metallic materials, other composite materials, or other similar materials. Moreover, the components of the assemblies may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A forward brace assembly for a firearm, the forward brace assembly comprising:

a forward portion designed to interface with an operator's off hand; and an aft panel extending rearward from the forward portion in a direction that is not perpendicular to a forward/aft direction of the firearm, wherein:

at least a portion of the forward brace assembly is attached to an underside of a handguard of the firearm; and the aft panel prevents the operator's off hand from wrapping around a rear side of the forward portion.

2. The forward brace assembly of claim 1, wherein the forward portion is approximately cylindrical.

3. The forward brace assembly of claim 1, wherein:

the forward portion and the aft panel are separate components; and the aft panel is attached directly to the underside of the handguard.

4. The forward brace assembly of claim 3, wherein the forward portion is attached to a rail on an underside of the aft panel.

5. The forward brace assembly of claim 1, wherein the forward portion and the aft panel are integrally formed as a single component.

6. The forward brace assembly of claim 1, wherein at least a portion of the forward portion comprises a polymer material.

7. The forward brace assembly of claim 1, wherein the forward portion is angled rearward.

8. The forward brace assembly of claim 1, wherein the aft panel comprises a modular component such that the aft panel comprises a plurality of sections that are removably attached to one another.

9. The forward brace assembly of claim 1, further comprising at least one thumb rest extending in a lateral direction.

10. The forward brace assembly of claim 8, wherein the plurality of sections comprise varying lengths extending down from the handguard.

11. The forward brace assembly of claim 1, further comprising at least one accessory selected from the group of a flashlight, a laser, an infrared laser or light emitter, an ultraviolet light emitter, a microphone, a regular camera, a night-vision camera, a thermal imaging camera, an infrared camera, and a forward-looking infrared (FLIR).

12. A firearm comprising:

at least one receiver with a magazine well;

a pistol grip attached to the at least one receiver, wherein the pistol grip is designed to interface with an operator's shooting hand;

a handguard disposed forward of the at least one receiver;

a forward brace assembly disposed below the handguard, the forward brace assembly comprising:

a forward portion designed to interface with an operator's off hand; and an aft panel extending rearward from the forward portion, wherein:

the aft panel is attached to an underside of the handguard at a first attachment portion;

the forward portion is attached to a rail on an underside of the aft panel such that the rail extends in a direction that is not perpendicular to a direction of the first attachment portion; and the aft panel prevents the operator's off hand from wrapping around a rear side of the forward portion.

13. The firearm of claim 12, wherein the forward portion is approximately cylindrical and the aft panel is a plate shape.

14. The firearm of claim 12, wherein:

the forward portion and the aft panel are separate components; and the forward portion and the aft panel are removably attached to one another.

15. The firearm of claim 12, wherein the forward portion and the aft panel are integrally formed as a single component.

16. The firearm of claim 12, wherein at least a portion of the forward portion comprises a polymer material.

17. The firearm of claim 12, wherein the forward portion is angled rearward.

18. The firearm of claim 12, wherein:

the aft panel comprises a modular component such that the aft panel comprises a plurality of sections that are removably attached to one another; and the plurality of sections comprises varying lengths extending down from the handguard.

19. The firearm of claim 18, wherein the plurality of sections are configured to fill in a space between the forward portion and the at least one receiver.

20. The firearm of claim 12, further comprising at least one accessory selected from the group of a flashlight, a laser, an infrared laser or light emitter, an ultraviolet light emitter, a microphone, a regular camera, a night-vision camera, a thermal imaging camera, an infrared camera, and a forward-looking infrared (FLIR).

21. The forward brace assembly of claim 1, wherein a height of the aft panel is approximately equal to a height of the forward portion.

22. The forward brace assembly of claim 11, wherein the at least one accessory is disposed on a forward side of the forward portion.

23. The firearm of claim 20, wherein the at least one accessory is disposed on a forward side of the forward portion.

24. A forward brace assembly for a firearm, the forward brace assembly comprising:

a forward portion designed to interface with an operator's off hand; and an aft panel extending rearward from the forward portion, wherein:

at least a portion of the forward brace assembly is attached to an underside of a handguard of the firearm;

the aft panel is modular such that sections of the aft panel are removably attached to one another to change the dimensions of the aft panel in at least one direction; and the aft panel prevents the operator's off hand from wrapping around a rear side of the forward portion.

25. The forward brace assembly of claim 24, wherein the aft panel can be extended in a forward/aft direction of the firearm by attaching at least one of the sections such that the aft panel extends to a receiver of the firearm.

* * * * *